US005495621A

United States Patent [19]

Kibbee

[11] Patent Number: 5,495,621

[45] Date of Patent: Mar. 5, 1996

[54] BODY ARMOR VEST ANCHORING SYSTEM AND METHOD

[76] Inventor: Rick E. Kibbee, 9470 Hunters Creek, Cincinnati, Ohio 45242

[21] Appl. No.: 406,370

[22] Filed: Mar. 17, 1995

Related U.S. Application Data

[63] Continuation-in-part of Ser. No. 58,985, May 5, 1993, Pat. No. 5,398,340.

[51] Int. Cl.[6] ..... F41H 1/02

[52] U.S. Cl. ..... 2/2.5; 2/102; 2/117

[58] Field of Search ..... 2/78.4, 112, 2, 2/2.5, 908, 92, 44, 120, 408, 403, 406, 229, 117, 115, 919, 920, 102

[56] References Cited

U.S. PATENT DOCUMENTS

| | | | |
|---|---|---|---|
| 1,246,274 | 11/1917 | Jelalian . | |
| 1,998,085 | 4/1935 | Jones | 2/78.4 |
| 2,671,222 | 3/1954 | Hochberg | 2/229 |
| 2,790,973 | 3/1954 | Lewis et al. . | |
| 3,292,181 | 3/1964 | Kennedy et al. . | |
| 3,696,439 | 10/1972 | Durham . | |
| 3,771,171 | 11/1973 | Mitchell . | |
| 4,074,364 | 2/1978 | Lucero | 2/117 |
| 4,597,109 | 7/1986 | Hironaga | 2/117 |
| 4,597,110 | 7/1986 | Smith, Sr. et al. | 2/406 |
| 4,660,223 | 4/1987 | Fritch . | |
| 4,697,285 | 10/1987 | Sylvester | 2/2 |
| 4,870,706 | 10/1989 | Ketcham et al. | 2/2 |
| 4,884,295 | 12/1989 | Cox . | |
| 4,989,266 | 2/1991 | Borgese et al. . | |
| 5,033,121 | 7/1991 | Larsen | 2/115 |
| 5,060,314 | 10/1991 | Lewis . | |
| 5,072,453 | 12/1991 | Widder . | |
| 5,073,985 | 12/1991 | Stone et al. . | |
| 5,127,105 | 7/1992 | Sacks . | |
| 5,187,817 | 2/1993 | Zolner . | |
| 5,398,340 | 3/1995 | Kibbee | 2/2.5 |

FOREIGN PATENT DOCUMENTS

| | | | |
|---|---|---|---|
| 2249941 | 5/1992 | United Kingdom | 2/403 |

OTHER PUBLICATIONS

Brochure entitled "Point Blank Body Armor" dated Jan., 1991.

*Primary Examiner*—Paul C. Lewis
*Attorney, Agent, or Firm*—Wood, Herron & Evans

[57] ABSTRACT

A body armor vest is anchored at the waist of a wearer by providing an elastic lower garment, preferably in the form of a legged brief type undergarment, that snugly fits the lower torso of the wearer. The lower garment anchors the vest in place by attaching along a strip across the front and back of the vest at the waist. The lower garment distributes an elastic force that horizontally and vertically returns the vest, when pulled out of position by the movement of the wearer, to its intended position, with the waist level thereof centered at the front and back of the wearer's waist. Detachable fasteners are provided to allow the easy putting on, adjustment and removal of the vest and lower garment combination. With the legged brief version of the lower garment, the fasteners preferably include strips of hook and loop material sets at the front and back of the waist on the vest shell and lower garment.

14 Claims, 4 Drawing Sheets

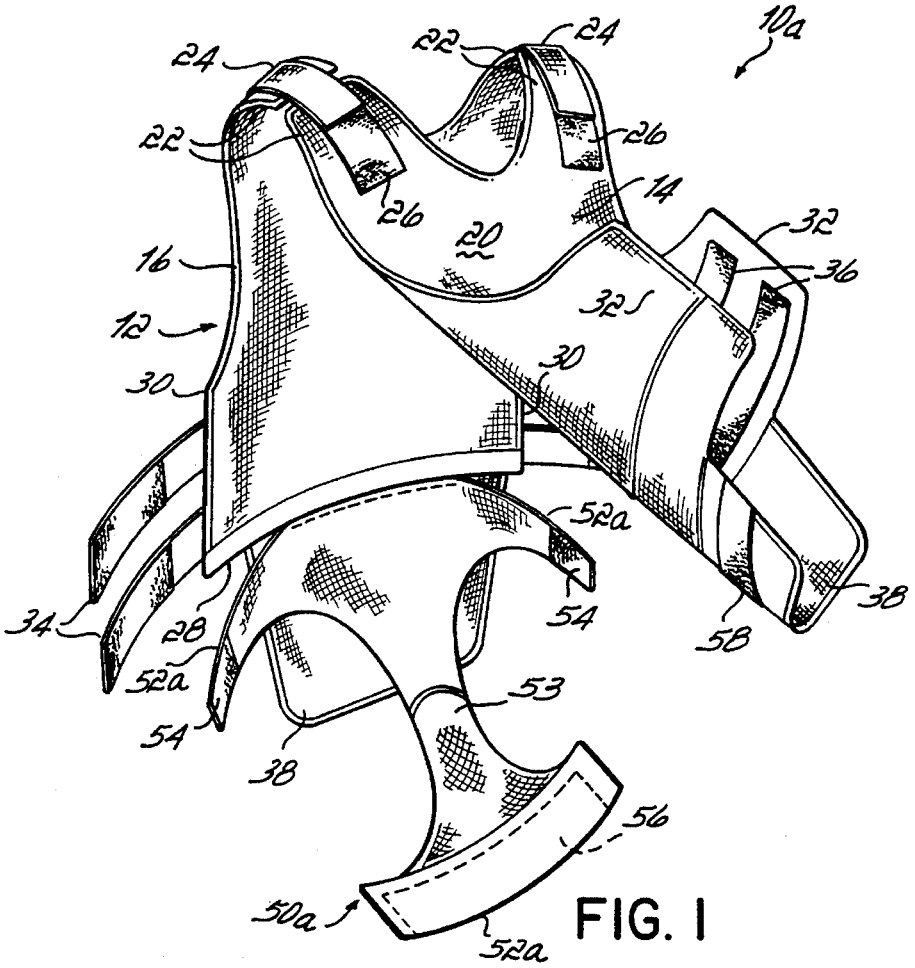
FIG. I
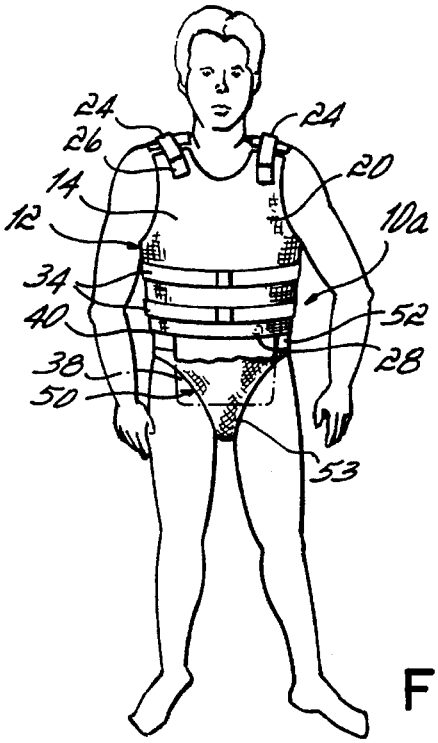
FIG. IA

BODY ARMOR VEST ANCHORING SYSTEM AND METHOD

This application is a continuation in part of U.S. patent application Ser. No. 08/058,985, filed May 5, 1993 now U.S. Pat. No. 5,398,340 entitled Bullet Resistant Vest and Vest Cover.

FIELD OF INVENTION

The present invention relates to anti-ballistic clothing and primarily to protective clothing referred to as the bullet resistant or bullet proof vests or body armor. More particularly, the present invention relates to fabric apparel that contain and hold in place on the body of a wearer the bullet resistant panels of impact absorbing material, such as are worn by law enforcement personnel in the line of duty.

BACKGROUND OF THE INVENTION

Bullet resistant vests have become standard equipment for many law enforcement officers including the members of most state and local police departments. These vests are made of a fabric shell, usually of a woven material, containing compartments, usually in the form of pockets, which fully encircle the torso of the wearer, and in which are contained, so as to fully occupy the pockets, a plurality of removable panels of impact absorbing anti-ballistic material such as that known as Kevlar®, which is a registered trademark of E.I. dupont, Inc. Other such materials are known as Spectra® a registered trademark of Allied Signal, Inc. and Twaron® a registered trademark of Akzo, Inc. The vests are designed so that the torso of the wearer is surrounded, at least from the neck to the waist, with a layer of the protective panels. These vests are commonly known by the public as bullet proof vests, and in the law enforcement community as body armor, and the terms are used interchangeably herein. Such vests resist and usually prevent penetration of most small arms bullets when effectively worn.

Routine usage of these vests provides law enforcement officers a degree of protection from injury or death from firearms. Such regular or routine usage, however, subjects the law enforcement officer to considerable inconvenience and discomfort. This usage requires the law enforcement officer to wear the vest throughout the entire workday, particularly on street duty. Such vests are often worn beneath the shirt of a standard uniform. While the panels of the vests will bend somewhat, they do not stretch or shear, and thus, when the vests are worn, they are stiff and constantly shift from their desired body protective position, requiring constant readjustment by a law enforcement officer wearing one.

In the line of ordinary duty, the law enforcement officer is highly active: walking, reaching, bending, twisting, and stretching while patrolling, entering and leaving vehicles, dealing with suspects and other members of the public, rendering assistance, dealing with disturbances, making arrests and engaging in other routine activities. In the course of such duty, vest panels that are only moderately flexible but inelastic, and that will bend somewhat but will not stretch, do not conform to the shape of the law enforcement officer's body as it moves over the course of the day.

In the design of bullet proof vests, various straps, ties and tails have been incorporated to retain the generally protective arrangement of the panels and to fit the vest assembly to the body of the wearer. These have not been effective to hold the vest in place throughout an officer's work day. The common experience of the law enforcement officer wearing these vests is that they tend to move upward on the body, away from the waist and toward and around the neck of the wearer, exposing much of the officer's midsection above the waist. The vests also have a tendency to twist in relation to the officer's body and outer clothing. Such shifting and movement of the vest on the body of the officer wearing one limits the protection that the vest provides and requires the wearer to take the time at frequent intervals throughout the day for readjustment of the vest and the clothing to move the vest back to its desired position on the wearer's body. Accordingly, there has been a long felt need for a system and method for anchoring such bullet proof vests in place when they are worn particularly by law enforcement officers.

More elaborate strapping attachments have been proposed for such types of protective garments as are used in military applications, particularly by those confined to vehicles such as combat aircraft and land vehicles, but these designs have not been suitable for the day to day use by a law enforcement officer.

The typical approach to the anchoring of bullet proof vests worn by law enforcement officers is the provision by the manufacturer of somewhat traditional shirt tails on the vest shell. Such tails rely on the holding power of the wearing officer's belt or pants to hold the vest down and in place at the level of the officer's waist. However, as the officer moves, such tails inevitably pull upward or toward one side. Once out of position, the tails do not return to their desired positions, but are instead held out of position by the belt or other parts of the outer uniform of the wearing officer.

Furthermore, bullet proof vests must be provided for law enforcement officers of a variety of sizes and shapes, male and female. Any vest component or vest anchoring system must be provided to accommodate all potential wearers. Because the market for such vests is far smaller than the market for most types of everyday clothing worn by the public, any garment that forms part of a vest anchoring system, if it must be made in a large number of sizes and shapes, will unacceptably increase the cost to law enforcement agencies or to individual law enforcement officers of dressing for duty with adequate body armor protection. The economic resources of both the law enforcement agencies and the individual law enforcement officers is typically quite limited. Thus, if an anchoring system and method for bullet proof vests is to be worn by most law enforcement officers and provide them the increased safety of a properly anchored vest, then it must be provided in a manner that is economically feasible to those who must pay for their procurement.

Thus, there is a need for an anchoring method and system for ballistic resistant vests worn by law enforcement officers in every day duty that retain the impact absorbing panels of such vests in effective protective positions while accommodating the mobility of wearer, and preserve the comfort and neatness of the vest and the uniform of the wearing officer throughout the day.

SUMMARY OF THE INVENTION

A primary objective of the present invention is to provide a flexible anchoring system and method for a bullet resistant vest that will preserve the position of the protective panels of the vest and maintain the comfort, neatness, mobility and protection of the law enforcement officer wearing the vest in the line of duty throughout the day.

It is a particular objective of the present invention to provide a bullet resistant vest having a cover or shell that makes it easy for the law enforcement officer to put on and adjust to the proper wearing position and that will remain in position beneath the officer's uniform as the officer performs body movements throughout the normal day of duty.

It is a further objective of the present invention to provide a method and system for anchoring a bullet proof vest on the body of a wearer in which a minimal number of sizes and shapes will serve the needs of all sizes and shapes of law enforcement officers, both male and female. It is a more particular objective of the present invention to provide a method and system for anchoring bullet proof vests that will utilize, with minimal special adaptation, articles of clothing and materials manufactured for larger and more economical markets.

According to the principles of the present invention, a ballistic or bullet resistant vest is provided with a system for holding impact absorbing or resistant panels in positions surrounding the upper torso of a wearer, at least partially suspending the vest from the wearer's shoulders, and preferably elastically anchored in position in the area of the wearer's waist. The system and method of the present invention holds the panels in position by securing the vest in the vicinity of the waist of the wearer in relation to the wearer's lower torso when fitted or adjusted to the wearer when in a normal posture, and then to continually urge the protective panels of the vest into vertical and circumferential registration with respect to wearer's waist. Thus, while the portion of the bullet proof vest that normally aligns with the wearer's waist may be pulled upward or toward the wearer's side by movements of the wearer, when the posture of the wearer returns to a normal stance that portion of the vest returns to a centered position at the level of the wearer's waist.

In furtherance of these objectives, in the preferred embodiment of the invention, a shell includes a conventional upper shell portion which carries the protective panels in fixed pockets or compartments thereon. The shell has shoulder straps or other such portions that register the vest with the shoulders and upper body of the wearer. The shell is provided with a flexible anchoring system that includes a lower garment portion of preferably one piece and formed of a generally elastic material. The lower garment portion is securable to the upper portion to elastically hold the vest in position with respect to the waist of the wearer, permitting the vest to move away from the waist with the body movements of the wearer, but to return to the desired position with respect to the wearer's waist.

The lower portion preferably includes a horizontal section preferably in the form of a waistband that extends around the waist of the wearer. The lower portion also preferably includes a body portion that extends downwardly from the waistband to generally surround the lower torso of the wearer. This body portion forms, at least in part, a generally vertical section, such as a crotch section, that extends between the legs of the wearer, conforming to the lower torso of the wearer in the manner of a conventional undergarment. Such a body section or crotch section preferably connects to the horizontal section along an extended area or at least at spaced apart points on the front and back, and may take the form of specially constructed extensions at least partially secured to the upper vest portion, or may take at least partially of a more standard or conventional undergarment, such as a pair of underwear briefs or an athletic supporter, and is preferably be constructed by modification of such garment.

The lower garment portion of the vest is, when worn by the wearer, connected at the center of the front and back of the waistband to the panel portion of the vest, at a level generally designed to align with the waist of the wearer. The lower portion is at least partially detachable, preferably from the upper garment portion at the waistband, and preferably in the center of the front thereof, and in at least one embodiment also detachable at the waistband from the upper vest portion at the center of the back.

In one preferred embodiment of the invention, the lower garment portion is a modified form of a pair of elastic legged briefs, which are made preferably of an elastically knitted material, and/or preferably have a broad elastomeric waistband a body hugging body portion formed of a fabric that contains, at least in part, an elastic fabric or thread. Such legged briefs are adaptable into lower garments to form an anchoring system for bullet proof vests that fit both male and female law enforcement officers over a moderate range of sizes, such that a small number of sizes, for example three, may fit all or the vast majority of wearers.

In the preferred embodiments of the invention, the lower garment has three potential areas or zones at which it can be separated and reconnected to facilitate the putting on and taking off of the vest and to simplify the adjustment of the vest on the wearer's body in each of the preferred embodiments illustrated and described below, detachable connections in at least two of these three areas are provided to permit easy and convenient use by the wearer and minimize the time and effort in putting on and adjusting the vest. At the areas of detachable connection, pressure responsive connection material is preferably employed, as for example as hook and loop fastener material or tape such as that available under the trademark Velcro®.

The three preferred areas of connection include a first area that includes a connection point between the front center of the waistband of the lower garment to a point at the front center waist level the vest cover. In both of the illustrated embodiments, this area is made detachable. A second area of connection includes a connection point between the back center of the waistband of the lower garment to a point at the back center waist level the vest cover. In a first illustrated embodiment, this attachment area is a permanent connection. In a second illustrated embodiment, this connection area is a detachable connection. The third area of connection includes points on both sides of the waistband of the lower garment in the vicinity of the hips of the wearer.

In one embodiment in which the back connection is permanent, the side connection points are detachable, permitting the wearer to install and remove the vest by disconnecting the front connection and side connections, leaving the lower garment attached to the panel carrying shell portion at the back. In the second embodiment in which the back connection is detachable, the side connection points are permanent, thus permitting a continuous waistband, and a fully detachable lower garment portion that can be put on and removed by the wearer in the same manner as a conventional undergarment.

In another embodiment of the invention, a fourth area of connection located in the crotch portion between the legs of the wearer is made a detachable connection point. In this embodiment, the second area of connection that is made detachable is that which includes the side connection points.

In its various embodiments, the lower garment elastically secures the upper vest portion of the shell at the front and back centers of the waistline of the wearer, with a continuous elastic waistband that encircles the waist of the wearer in a first path of elastic attachment between the front and back parts of the shell, and with a continuous crotch portion that connects these points in a second path between the legs of the wearer. The lower garment provides two detachable connections, one for interrupting each of the paths, so that the vest can be put on and removed from the wearer. Preferably, the waistband is several inches wide, and preferably also the crotch portion is V-shaped, connecting to the waistband at spaced points on the front and back, forming a triangular shape to better maintain the centers of the waistband in place at the front and back center of the wearer's waist. In these embodiments, there is preferably provided sufficiently strong elastic around the top of the wearer's thighs to provide distributed forces downwardly from the centers of the front and back of the waistband toward the sides of the wearer's legs.

In certain embodiments, a legged brief lower garment anchoring system and method provides a more extended elastic body section of an elastic fiber containing material in which extended bands of the material encircle the thighs of the wearer, providing secure anchoring points at both sides of the legs of the wearer, adding to the downward securing action of a section of the garment that extends between the legs of the wearer. These leg encircling elastic bands are formed of lower ends of the elastic fabric containing material of the body portion of a brief that extends to, and is generally sewn along, a widened waistband of the brief, particularly across the width of the front and back. This not only directs the correction forces imposed by the elastic material not only in a downward direction, but distributes the forces laterally toward the sides of the wearer's legs, and thereby reduces discomfort that could be caused by concentration of such forces during extreme stretching or activity of the wearer. Such an embodiment is effective and comfortable for a large percentage of wearers.

Such a legged brief version of the lower garment portion may be made from preformed commercially available legged briefs, and preferably modified by the replacement of or addition to the waistband to form a widened waistband of preferably approximately two inches wide or wider. To the waistband, one portion, preferably the loop portion of hook and loop tape is sewn, one piece at the front and one at the back, with the other and preferably hook portion sewn to at the front and back of the waist level of the vest portion of the shell. In one preferred embodiment, elastic loop tape is sewn to the waistband of the lower garment. Elastic tape that is commercially available will stretch from fifty-five up to about one hundred percent, which will accommodate and conform to the stretch of the elastic waistband when made to the wearer's size. Greater stretch percentages will, however, allow accomodation of a greater size range of wearers.

With the present invention, the wearer puts on the vest and adjusts the panels and upper shell portion to the desired position. Then the anchoring system is set in place by positioning the lower garment about the lower torso of the wearer, with the elastic waistband surrounding the wearer's waist, and with the crotch portion extending between the wearer's legs. In doing so, the two detachable connections are attached so that the waistband surrounds the wearer's waist, with the waist level of the shell connected to the waistband at the center, front and back.

So designed and worn, the centers of the back and front of the upper portion of the vest shell, which usually coincide with the bottom edges of the impact resistant panels, are held in position at the front and back centers of the wearer's waist. As the non-elastic panels move with respect to the wearer's waist with the upper torso and shoulder movement of the wearer, the front and back centers of the waist level of the upper portion of the vest remain attached to the respective front and back centers of the waistband of the elastic lower garment, and are constantly pulled back to their initial positions at the front and back of the wearer's waist, as the lower garment stretches but remains in conformity with the lower torso of the wearer.

As configured, the lower garment portion of the shell connects the front and back parts of the upper vest portion together at the front and back waist level, both with the waistband around the waist of the wearer and with the crotch section between the legs of the wearer. By being disconnectably configured in at least two areas, both the waist and crotch connections between these front and back parts can be broken for easy putting on and removal of the vest.

These and other objectives and advantages of the present invention will be apparent from the following detailed description of the drawings in which:

BRIEF DESCRIPTION OF THE DRAWINGS

FIG. 1 is a perspective view of a bullet resistant vest and a vest shell assembly according to the principles of the present invention, illustrating one embodiment of the vest in an unfastened condition, which employs an anchoring system having a lower garment portion that is permanently connected to the vest shell at the back and detachably connected to the vest shell in the front, with a waistband that also disconnects at the sides.

FIG. 1A is a perspective view of a the vest of FIG. 1 on a wearer in the arrangement it would assume when in fastened condition when being worn by a user.

DETAILED DESCRIPTION OF THE DRAWINGS

Figure 2:
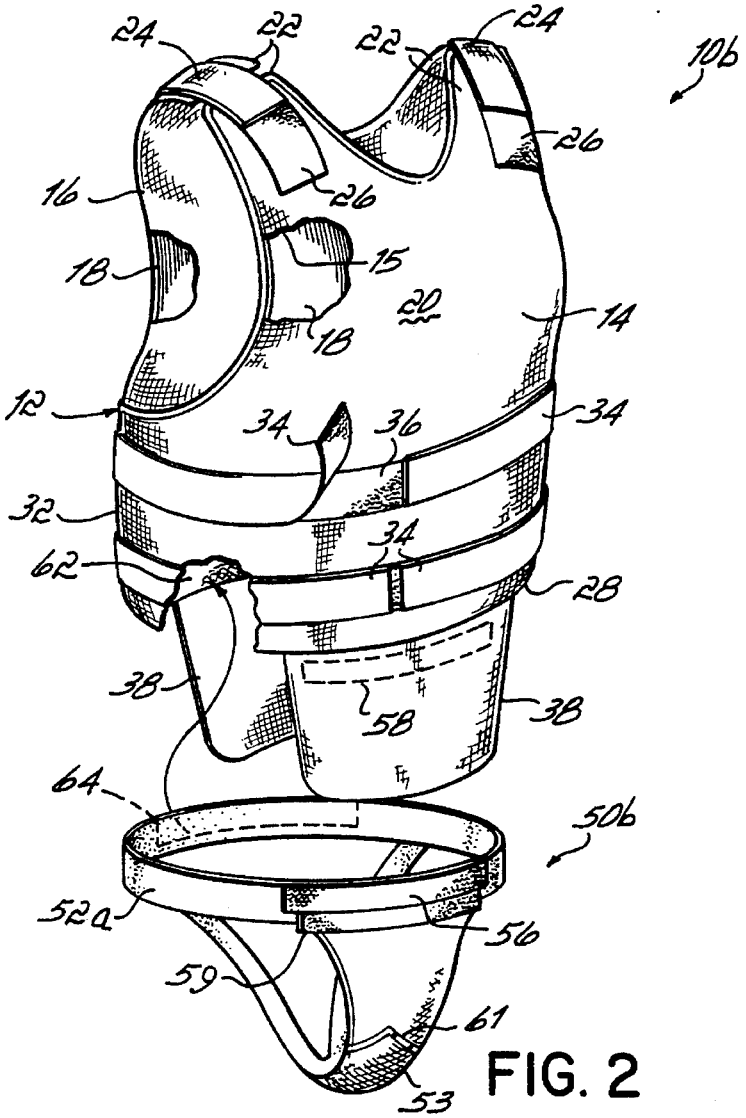
FIG. 2 is a perspective view similar to FIG. 1 illustrating a second embodiment of the invention employing an anchoring system having a lower garment portion with a continuous waistband detachably connectable to the vest shell at the front and back.

The illustrated embodiments of the bullet resistant or bullet proof protective vest 10, depicted respectively as vest assemblies 10*a* in the embodiment of FIG. 1 and 10*b* of FIG. 2, each including an upper or vest portion 12 and a lower garment portion 50, depicted respectively as lower garment portions 50*a* and 50*b* therein. The upper vest portion 12 of the protective vest 10 is a form of a conventional bullet resistant vest of the type in widespread use today by state, local and certain federal law enforcement agents, modified as described below to connect to the lower garment portion. The conventional vest of the upper vest portion 12 is made up of sometimes one part, but usually of separate front and back parts 14 and 16, respectively, that are adjustable at the shoulders, such as by making the front and back parts 14 and 16 detachably and adjustably connected together to form the protective portion 12 that generally fits the upper torso of the user.

Referring to both FIGS. 1 and 2, the conventional vest is, as is the upper vest portion 12, made up of protective panels 18 (FIG. 2) of impact absorbing or resisting material, such as the products known as Kevlar®, Spectra® or Twaron®. The panels 18 include one or more sections that are usually contained in pockets or compartments 15 in each of the front and back parts 14 and 16 of the vest 12. The panels 18 are insertable into the compartments 15 through slits (not shown) usually accessible from the inside of a conventional vest cover or vest shell 20, which is familiar to vest manufacturers and users. The shell 20 is a washable fabric garment that contains and holds in operative position the panels 18 for protection of the wearer. Such a conventional vest, as well as alternative and improved versions thereof, forms the major part of upper portion of the protective garment 10 of the preferred embodiments of the present invention. The impact resistant material, which will stop, deflect or substantially retard most bullets and of which the panels 18 are formed, is moderately flexible, permitting the panels to bend, as illustrated in FIG. 1. The material, however, does not stretch, and, accordingly, once fastened, as illustrated in FIG. 2, to be worn as illustrated in FIG. 1A presents a somewhat rigid enclosure around the upper torso of the wearer.

Referring to FIG. 1, the front and back parts 14 and 16 of the conventional vest 12 each have a pair of shoulder flaps 22, including a right flap and a left flap, each connectable together with the corresponding flap of the other part 14 or 16, usually by hook and loop tape shoulder strap assemblies that include straps 24 and pads 26. The straps 24 are usually the hook portion of the hook and loop tape and are attached to the shoulder flaps 22 of the back part 16 of the vest 12, and are attachable to the pads 26, which are usually sewn to the flaps 22 of the front part 14 of the shell 20 of the upper vest portion 12.

Normally, the user adjusts the straps 24 on the pads 26 so that the bottom edge of the protective panels 18 aligns with the waist of the user at a waist level 28, as illustrated in FIG. 1A, so that the bottom edge of the panels 18 will touch the upper edge of the wearer's belt. Once adjusted, the user will remove and put on the vest overhead, with the shoulder straps 24 attached so that they need not be repeatedly readjusted.

The conventional vest 20, as does the upper vest portion 12, has a pair of short side flaps 30 on the back part 16 and a pair of longer side flaps 32 on the front part 14 of the vest 12. As with the shoulder flaps 22, the side flaps 30 and 32 connect together with hook and loop tape, with straps 34, which usually carry the hook portion of the tape, sewn to the back flaps 32 of the back part 16, and pads 36, made of the loop portion of the tape, sewn to the flaps 32 of the front part 14 on the vest 20. When the vest 20 of the upper vest portion 12 is positioned on the shoulders of the wearer, with the waist level 28 aligned with the waist of the wearer, the straps 34 are adjusted such the rear edge of the panels 18 of the front part 14 of the vest 20 about the forward edge of the panels 18 of the back part 16 along the wearer's sides. Where the vest 20 is the proper size for the user, the panels 18 will encircle the torso of the wearer in a moderate to snug fit, as illustrated in FIGS. 1A and 2. The front and back parts 14 and 16, respectively, of the vest 20 are customarily respectively provided with front and back tails 38 that are tucked into the pants of the user when the vest 12 is worn, to attempt to keep the vest 12 in position.

Figures 4, 4A, 4B, 4C:
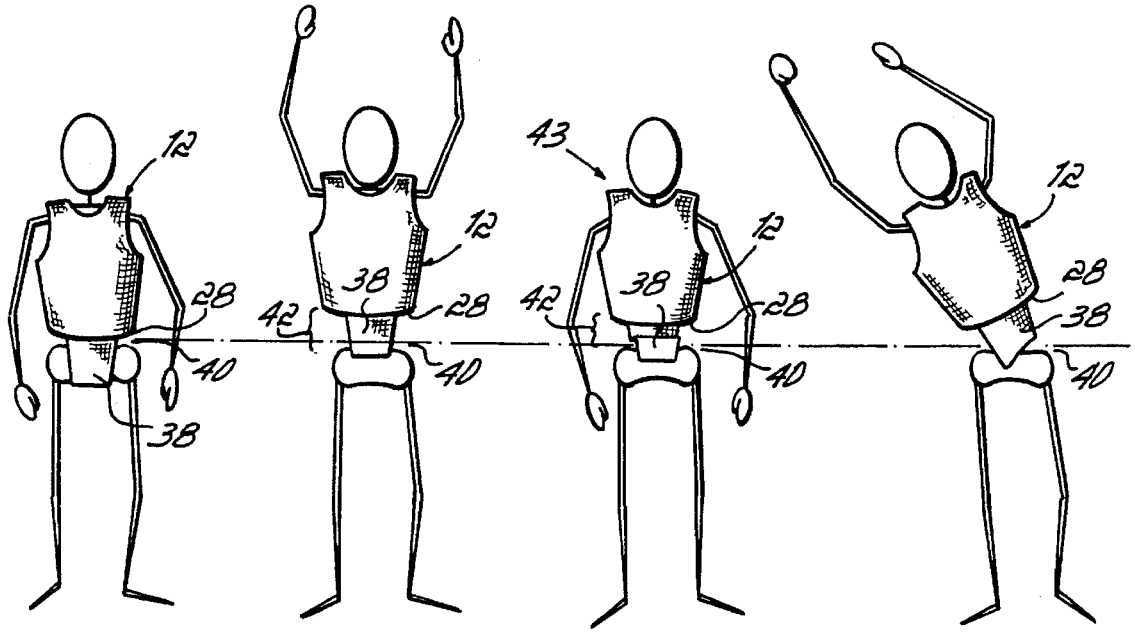
FIG. 4 FIG. 4A FIG. 4B FIG. 4C PRIOR ART
FIG. 4–4C are a series of diagrammatic illustrations showing the problems presented by vests of the prior art in retaining their position on the user.

FIG. 4 illustrates a conventional vest 20 such as that used in forming the upper portion 12 of the anchored vest of the preferred embodiments of the invention. The vest 20 is shown positioned and adjusted on a user, with the waist level 28 of the vest 12 at the waist 40 of the user. As shown in FIG. 4A, when the user reaches upward, the user's upper torso stretches, and the user's shoulders lift the unstretchable panels 18 such that the waist level 28 of the vest 20 is lifted above the waist 40 of the user, exposing the midsection of the user, as illustrated at 42. This causes the tails 38 to be pulled up from behind the user's belt. In this way, the vest 20 rides up against the user's body and beneath a uniform such that, when the arms are lowered, the tails 38 remain pulled above the belt to a degree and the waist level 28 of the vest 20 settles above the waist 40 of the user, as illustrated in FIG. 4B, leaving gap 42 at the midsection of the user. The panels 18 are also left raised up in the area of the neck of the wearer, as illustrated at 43.

Furthermore, when the user leans or stretches to one side or the other, as illustrated in FIG. 4C, the vest 20 rides up more on one side than the other, pulling the tails 38 to one side, so that the vest may become asymmetrically moved out of position when the user returns to the posture illustrated in FIG. 4B. In some military applications, such as for pilots of military aircraft, where the wearer of a vest remains more or less in a stationary position, canvas or nylon straps have been used connecting the shell 20 of the vest 12 between the legs of the wearer. This, however, interferes with the mobility of the user, while only partially solving the problems illustrated in FIGS. 4–4C, and particularly does not prevent misalignment of the vest as illustrated in FIGS. 4C and 4B. As such, the use of straps that are inelastic, or straps that connect only to the shell 20, are unsuitable for the daily use of active law enforcement officers.

Referring again to FIG. 1, in accordance with one embodiment of the present invention, a lower garment portion 50 (i.e., **50*a* in FIG. 1 or 50*b* in FIG. 2) is provided, having an waistband 52 that is formed of elastic material that typically includes a stretchable polymer fiber such as synthetic rubber. In the embodiment 10*a*, a lower garment in the form 50*a* has a waistband that is in the form of waistband 52*a*, split at the sides. The garment 50*a* also has a crotch portion 53** that is formed of elastic material, preferably a knitted cloth material, which derives its elastic properties from the knit stitching employed.

In the embodiment of FIG. 1, the center of the waistband **52*a* of the lower garment portion 50*a* of the vest 10*a* is permanently sewn at the waist level 28 to the shell 20 on the back part 16 of the upper vest portion 12. At both of the sides, the waistband 52*a* is interrupted, where there is provided hook and loop connection tape having straps 54 that carry the hooked portion 55 of the tape sewn to the ends of the back part of the waistband, and a pad 56 that carries the loop portion of the connection tape sewn to the ends of the front part of the waistband. The pad 56 may also be a series of small pieces of the loop portion of the tape sewn across the front of the waistband or may be a single pad 56, as illustrated, extending across the front of the waistband to each of the ends thereof. A one piece continuous pad 56** across the entire front of the waistband is preferably an elastic type that will stretch with the elastic waistband.

Sewn to the inside the front tail 38 is also one portion of a hoop and loop tape connector 58, preferably also contained the hooked half of the connector. The tape connector 58 thereby is effective to connect the front part 14 upper vest portion 12 at the waist level 28 thereof to the waistband **52*a* of the lower garment portion 50 at the front, either by attachment to a separate looped piece (not shown) of the tape sewn to the waistband of the lower garment portion or to the looped pad 56**, particularly where a single elastic piece thereof is sewn across the front of the waistband.

In the embodiment of FIG. 1, alternatives may be formed by modifying the lower garment portion 50*a* so that the waistband 52*a* is permanently sewn at the waist level 28 of the front part 14 at the front tail 38, where the pad 56 connects to the tape 58 in the form illustrated in FIG. 1, and with a detachable connection area in the crotch section 53, between the legs of the wearer. Further, the connections such as those of the waistband straps 54 and the crotch section 53 may connect directly or to the waist level section 28 of the upper vest portion 12, by connecting to each other and then one of them connecting to the vest portion, as in the illustrated embodiments.

To put on the vest of the embodiment 10*a*, the wearer fastens and adjusts the conventional vest 12 as described above, then attaches the side straps 54 to the pad 56 of the waistband 52*a* so that the lower garment 50*a* is positioned comfortably on the user's lower torso with the waistband 52*a* about the user's waist, at the waist level 40. Since the upper vest 12 has been adjusted at the shoulders to the size of the wearer, the waist level 28 at the back will be at the wearer's waistline 40. Then, the wearer attaches tape portion 58 at the front part 14 of the shell 20 to the center of the tape portion 56 on the front of the waistband 52*a*, thereby bringing the waist level 28 in line with the waistband 52*a* at the front.

Figures 5, 5A, 5B:
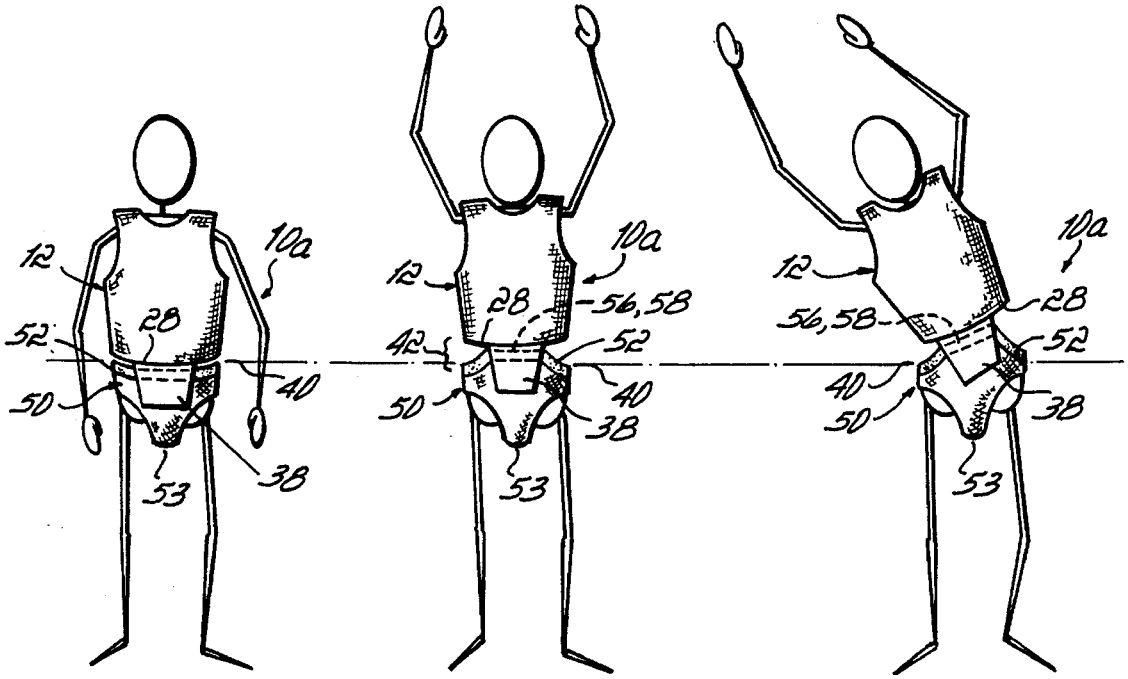
FIG. 5–5B are a series of diagrammatic illustrations showing that the problems illustrated in FIGS. 4–4C are overcome by vests according to the principles of the present invention.

As can be seen from FIGS. 5–5B, which each respectively correspond to the motions of the user in the prior art illustrated in FIGS. 4, 4A and 4C, the problems that arise with the conventional vest do not arise with the present invention. FIG. 5 appears the same as FIG. 4, except that the vest is secured to an elastic waistband 52 at the centers of the front and back at the waist 40 of the wearer. Thus, when the user's hands are raised, as in FIG. 5A, the vest portion 12, with its unstretchable panels 18, rises away from the waistline 40 of the wearer, also leaving the same space 42 that is illustrated in FIG. 4A. In FIG. 5A, however, the elastic waistband 52 stretches upward, and the crotch portion 53 stretches linearly, to follow the waist level 28 to which it is attached.

When the arms of the user are then lowered, however, unlike the vest of the prior art illustrated in FIG. 4B, the center of the vest at the waist level 28 pulled back down to the waistline 40 of the wearer, pulling the entire vest portion 12 downward such that the bottoms of the panels 18 again rest at the level of the waistline 40 of the user, returning the vest to the same arrangement as illustrated in FIG. 5, except that the tails 38 may be pulled up somewhat at the belt of the wearer.

When the wearer assumes a position of stretching to the side, as illustrated in FIG. 5B, the waistband 52 similarly extends upward, but tends to pull the waist level 28 of the vest also toward the center, because the waistband 52 is fitted about and elastically encircles the waistline 40 of the wearer. Thus, when the user relaxes, the elastic lower garment 50 pulls the vest 10 again to the center and to the waist line 40 of the user, to again assume the position of FIG. 5, rather than the condition of FIG. 4B.

Figure 3:
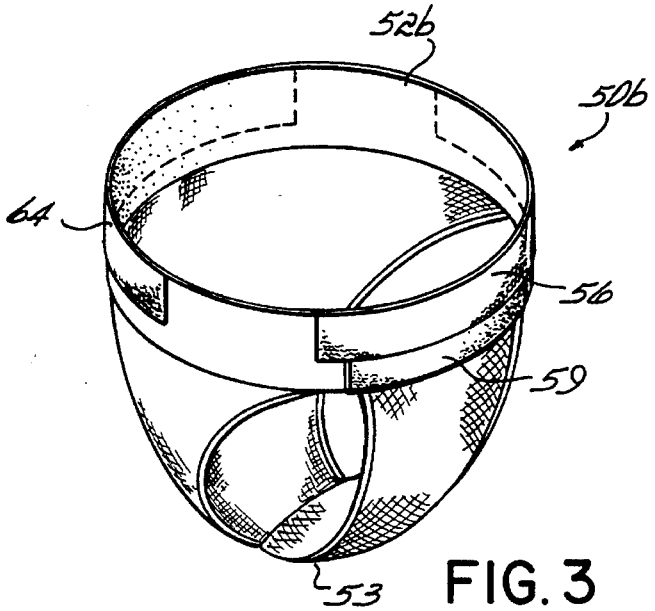
FIG. 3 is a perspective view of an alternative form of the lower garment portion of the embodiment of FIG. 2.

The embodiment of the invention illustrated in FIG. 2, when assembled on the wearer, functions similar to the embodiment of FIG. 1, also as illustrated in the series of FIGS. 5–5B. However, the embodiment of FIG. 2 is put on and connected differently. As illustrated in FIG. 2, the lower garment 50 is in the form of a conventional undergarment 50*b*, that may take the form of an athletic supporter, as illustrated in FIG. 2, or briefs designed for either male or female anatomy, the female version of which is illustrated in FIG. 3. To facilitate the use of the bathroom by the wearer without total disassembly of the lower garment 50 from the upper shell 12, either or both of the versions 50*a* or 50*b* of the lower garment 50 may be provided with a crotch portion 53 that is detachable, for example, along the front of the waistband 52, by provision of a hook and loop connector 59. Further, a fly 61 may also be provided for the male version, of the embodiments of either FIG. 2 or FIG. 3.

The lower garment 50 is preferably in one piece, particularly for the embodiments 50*b*. The lower garment 50*b* is provided with a continuous waistband 52*b*. At the front of the waistband 52*b* is provided the pad 56, which is one portion of hook and loop connector tape, preferably the loop portion.

The lower garment 50 of either embodiment 50*a* or 50*b*, as described above, is provided with detachable connections, whether hook and loop, buttons, snaps or other fasteners, at two of three possible attachment locations, front, back or on both sides. The embodiments using the form of lower garment 50*a* of FIG. 1 are detachable at locations on the front and sides (both sides), while embodiments using the lower garment 50*b* of FIG. 2 are detachable at the front and back with the side locations being permanently connected by virtue of the continuous waistband 52*b*.

In the embodiment of FIG. 1, the center back of the waistband 52*a* is permanently attached to the waist level 28 at the center of the back part 16 of the upper vest portion 12 and the sides of the waistband 52*a*, which are the third possible third detachable connection area, are made detachable by the split waistband 52*a* at the sides. With the lower garment 50*b* of the embodiments of FIG. 2, the back center of the waistband 52*b* is detachably connected to the center of the waist level 28 of the back part 16 of the upper vest 12. Further, while additional embodiments could be formed by maintaining a permanent connection at the front, with the back and side areas being provided with detachable connections, such form will usually be less convenient. Where side disconnections are used as in the embodiment of FIG. 1, the second connection may be at the waistband 52 or lower, at any point between the front and back.

In the embodiment of FIG. 2, the continuous waistband 52*b* may be regarded as permanently connected at the sides, with the other two potential connection areas, at the center front and center back of the waistband 52*b*, detachable connectable to the waist level 28 at the front and back parts 14 and 16, respectively, of the vest 12. Thus, instead of hook and loop tape at the sides of the waistband 52*b*, and instead of the waistband 52*b* being sewn to the vest back part at the waist level 28, hook and loop connector tape is provided at the center of the waistband 52*b* at the back, preferably the loop portion 62 thereof, with the opposite portion 64 of the hook and loop tape sewn to the back part 16 of the vest 12 at the waist level 28. In such an embodiment, the lower garment portion may thus be formed of a conventional undergarment.

To put on the vest assembly 10*b*, the user steps into the lower garment 50*b*, thus positioning the waistband 52*b* at the users waist 40. Then, the upper vest portion 12 is put on over the head of the user and the waist level 28 set to the waistline 40 of the user. If the waist level 28 and waistline 40 do not line up, the shoulder straps 28 are adjusted. Then the side straps 34 are adjusted and connected as explained above.

When the top vest portion 12 and the lower garment portion 50*b* of the vest 10*b* are put on and positioned, the front and backs of both are connected together at their centers. Preferably, the back hook and loop tape portions 64 and 62 are joined together, and then the front hook and loop portions 58 and 60 are joined together, both aligning the waist level 28 of the vest portion vertically with the waistline 40 of the user at the front and back centers.

Figure 6:
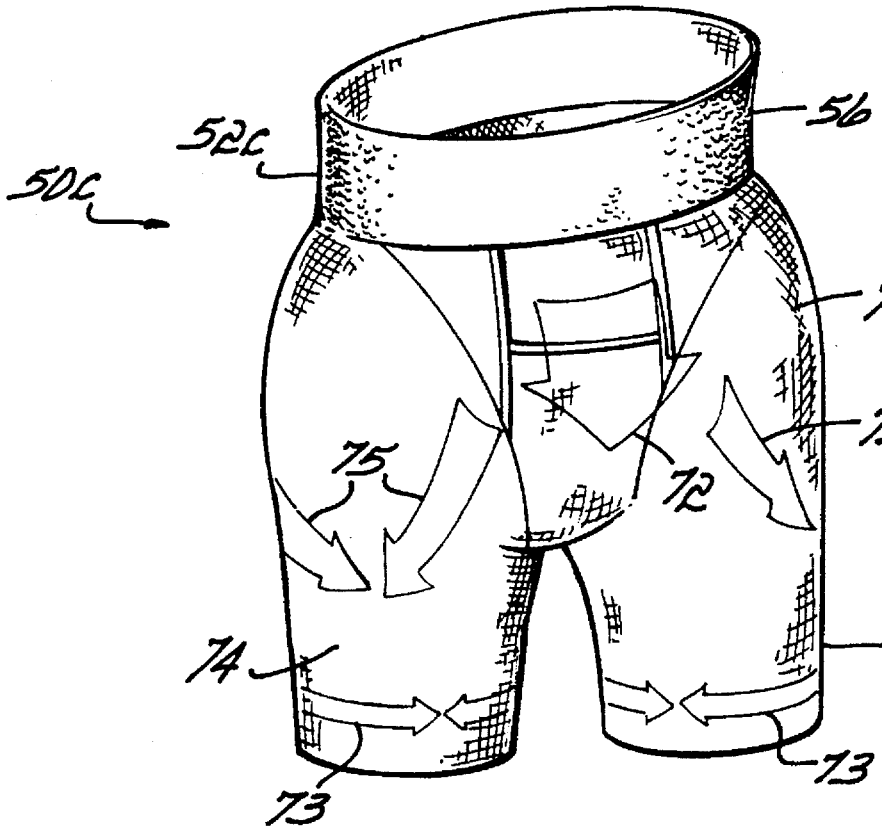
FIG. 6 is a perspective view similar to FIG. 3 illustrating a further alternative form of the lower garment portion of the embodiment of FIG. 2.

A further alternative to the lower garment 50 is illustrated as legged brief version 50*c*, illustrated in FIG. 6. This version may have essentially any or all of the features of the embodiment of FIG. 3, and form combination vest having essentially any or all of the features of the embodiment of FIG. 2, but will provide additional features and advantages. The lower garment portion 50*c* may be formed of a commercially available elastic legged brief undergarment elastic knitted material. While the elasticity of the material may be derived from a knitting of the fabric, which may be cotton, for example, the material is preferably formed of a fabric that contains at least some elastic fiber or thread. Such material may be, for example, cotton or other cloth material containing from two to ten or more percent of elastic such as Lycra® which is a registered trademark of E. I. DuPont of Wilmington, Del., or may be made entirely of stretchable synthetic fiber so that it exerts some force to urge the garment toward its original design shape. Undergarments manufactured by Jockey International Corporation of Kenosha, Wis. under the name Midway Athletic Brief are legged briefs that are adaptable into lower garments to form an anchoring system for bullet proof vests that fit both male and female law enforcement officers over a moderate range of sizes, such that a small number of sizes, for example three, may fit all or the vast majority of wearers. The Jockey legged brief garments have a waistband that is narrower than that preferred for the present invention but includes a body hugging portion that contains about two percent Lycra fiber, although a higher content of elastic fiber, of for example eight percent, is desirable.

Referring to FIG. 6, the lower garment 50*c* is preferably formed of a piece of elastic fabric portion 70 that snugly fits the wearer and an elastic waistband 52*c*. The waistband 52*c* is preferably wider than is typically provided by manufacturers of commercially available legged briefs, for example two to three inches wide. The widened waistband 52*c* is preferably fabricated by replacing the waistband of a commercially available legged brief with a wider one or may be formed by the addition of an additional strip of elastic parallel to the standard waistband, over the fabric 70 just below the waistband 52*c*. The loop portions 56 and 64 of the hook and loop tape of the embodiments of FIGS. 1, 2 and 3 may be used and sewn to the elastic waistband 52*c* at the front and back thereof, or, as in the alternative embodiment illustrated in FIG. 6, the waistband 52*c* may be formed entirely of a stretchable hook and loop material. Such stretchable hook and loop material manufactured under the trademark Velstretch by Velcro USA Incorporated, of Manchester, N.H.

With the use of either the conventional or stretchable hook and loop material, the elastic properties of the waistband can be realized and will better facilitate a wider range of sizes of wearers with any given size of lower garment if a plurality of small pads of the loop portion of the fastener are applied to the conventional waistband in narrow vertical strips or narrow horizontal strips. Arrangements of a plurality of strips staggered in a plurality of rows may provides an effective arrangement. The purpose of the arrangement of the fastener tape is to provide an extended area on the waistband for easy attachment of the upper vest portion to the waistband, while utilizing a sufficient portion of the width of the waistband to prevent rolling of the waistband due to the forces developed in holding the vest in place. The fabric portion 70 of the lower garment 50*c* provides vertical elasticity to urge the waistband back to the waist level, as with the lower garments 50*a* and 50*b*, as illustrated by the arrow 72 in FIG. 6. In addition, the fabric portion 70 of the lower garment 50*c* elastically encircles the thighs of the wearer, providing tension around the wearer's legs, as illustrated by the arrows 73. As a result, more stable anchoring points are provided on the fabric 70 at the outsides of the thighs of the wearer, as illustrated at points 74. As such, additional diagonally directed downward force, front and back, is applied by the fabric 70 to the front and back centers of the waistband 52*c*, as illustrated by the arrows 75. This force pattern more effectively and precisely centers and maintains the waist level of the vest 10 at the waist of the wearer, with greater comfort to the wearer. The version of the lower garment 50*c* fits the range of sizes and shapes of law enforcement officers, male or female, with a minimum of different sizes.

The embodiment of the invention that uses the lower garment 50*c* of FIG. 6 most effectively distributes the anchoring forces and the stretching of the lower garment 50 in such a way that the lower garment stays in place, returing to its initial shape after stretching. The extended leg provides for the elimination of a narrow stretch band that might concentrate force around the leg cut of other possible versions of a lower garment. The wider thigh encircling leg prevents the brief from riding up or bunching up in the crotch or buttocks areas. Further, with less restriction or force concentration in the crotch area, greater freedom of movement is provided, with greater comfort for the average wearer, while an easier fit for various body sizes is provided. The legged brief model provides a generally more acceptable appearance and a more professional and neater look that is consistent with the uniform dress.

The vest 10 and cover therefore of the present invention solves a problem that law enforcement officers have experienced who regularly must wear a bullet resistant vest in the line of duty. Such vests are currently supplied by a handful of manufacturers. All include Kevlar® or similar type panels carried in compartments of a fabric cover.

When worn, the vest, which is placed over the head of the wearer and suspended by the shoulder straps that are adjustable with Velcro® that connects front and rear parts over the shoulders and at the sides so that the Kevlar® panels surround the torso of the wearer between the waist and the arms and extend to near the shoulders on the chest and back. The vest forms a body encircling tube that is somewhat flexible but is of a non-elastic fixed circumference. Similarly, the bullet resistant panel sections are not elastic in the vertical direction between the waist and the shoulders of the wearer.

Prior to the present invention, no means have been provided on the vests to attach the vest at the bottom or to otherwise secure the vest to the wearer's body, and to align the waist level at the front and back of the vest, both laterally and vertically, at the wearer's waist. Only the shoulder straps and the fastening tape that overlies the panel compartments at the sides hold the panels together.

When a vest of the present invention is worn by law enforcement officer, difficulty experienced in keeping the vest in place is overcome. Over the course of a day on duty, the tendency of the vest to constantly ride up away from the wearer's waist and toward the neck of the wearer is corrected by the elastic lower garment, and the unique way it is connected to the vest, returning the vest to its proper position at which not only is the discomfort, inconvenience and a messy appearance of the prior art avoided, but the protective panels are maintained in the positions on the body of the law enforcement officer where the protective effects are most desired. Since these vests are worn under the officer's uniform, and usually under the shirt, constant restraightening of the vests, which is not always possible with the prior art, and is almost always inconvenient requiring at least partial disrobing, are unnecessary.

While certain embodiments of the invention have been herein described, those skilled in the art will appreciate that various additions, alternatives or modifications may be employed without departing from the present invention.

Accordingly, what is claimed is:

1. A bullet proof vest comprising:

a fabric shell having bullet resistant wearer protective panels of impact absorbing anti-ballistic material secured in fixed positions thereon so as to form a non-stretchable enclosure to at least partially protectively surround the upper torso of a wearer when the vest is worn, the shell having a front and a back, a waist level extending around the front and the back at the approximate height of a wearer's waist when the vest is worn, and at least two detachable fasteners spanning across a horizontal extent of the waist level at the front and back of the shell;

a horizontally and vertically elastic lower garment having:

a waistband of an elastic material including an elastic fiber and adapted to surround the waist of a wearer, a body portion having a top edge connected to the waistband and extending downwardly from the top edge to elastically extend between the legs of the wearer, the body portion including a pair of leg encircling bands each extending horizontally from between the legs of the wearer each to elastically surround one of the thighs of the wearer, the lower garment having a front and a back and mating fasteners extending horizontally across the front and the back, respectively, in the vicinity of the waistband and top edge of the body portion, and in detachable engagement with the detachable fasteners of the shell to thereby connect the front and back of the lower garment to the front and back of the shell at the waist level thereof, whereby the lower garment connects the back and front of the shell together and elastically holds the back and the front of the shell both vertically and horizontally at the waist level.

2. The vest of claim 1 wherein:

the waistband is a permanently continuous band of the elastic material;

the body portion is permanently connected at its front and back to the front and back of the waistband; and the detachable fasteners on the shell are in the form of the hook portions of hook and loop fastener material and the mating fasteners on the lower garment are each in the form of one or more pieces of the loop portion of hook and loop fastener material.

3. A bullet proof vest comprising:

a fabric shell having means thereon for maintaining bullet resistant wearer protective panels of impact absorbing anti-ballistic material in fixed positions thereon so as to form a non-stretchable enclosure to at least partially protectively surround the upper torso of a wearer when the vest is worn, the shell having a front and a back, a waist level extending around the front and the back thereof at the approximate height of a wearer's waist when the vest is worn, and means at the front and back of the waist level thereof for detachably fastening a lower garment thereto;

a horizontally and vertically elastic lower garment having a waistband of an elastic material including an elastic fiber adapted to surround the waist of a wearer and having means for elastically interconnecting the front and back of the waistband in paths through and around the legs of the wearer including a body portion formed of an elastic fiber containing material that, when worn, extends between the legs of the wearer and horizontally encircles the thighs of the wearer;

the front and back of the lower garment having means thereon for detachably fastening the front and the back thereof, in the vicinity of the waistband, to the front and back, respectively, of the shell, at the waist level thereof, by detachable engagement with the fastening means of the shell to elastically hold the back and the front of the shell both vertically and horizontally at the wearer's waist.

4. A method of anchoring a bullet resistant wearer protective vest in the vicinity of the waist level thereof at the waist of a wearer to thereby maintain bullet resistant wearer protective panels of impact absorbing anti-ballistic material carried thereby to form a nonstretchable enclosure which at least partially protectively surrounds the upper torso of a wearer when the vest is worn, wherein the vest includes a fabric shell having a front, a back and a waist level on the front and back thereof at the approximate height of the waist of the wearer when the vest is worn, the method including the steps of:

providing a horizontally and vertically elastic one piece lower garment having an elastic waistband and a body section connected to the waistband and extending downwardly therefrom;

connecting the lower garment along an extended length at the front and back thereof in the vicinity of the waistband to the front and back of the shell at the waist level thereof, to thereby elastically interconnect the front and back of the vest together along a first path around the waist of a wearer and along a second path between the legs of the wearer;

providing at least two disconnectable fasteners along the two paths to facilitate the putting on and removal of the vest and lower garment.

5. The method of claim 4 wherein:

the lower garment providing step includes the step of providing the lower garment having the elastic waisband having a width of at least two inches.

6. The method of claim 5 wherein:

the lower garment providing step includes the step of providing a legged brief having a body section formed of an elastic fiber containing material, the body section having leg encircling bands thereof having a width of at least two inches.

7. The method of claim 6 wherein:

the disconnectable fastener providing step includes the step of providing hook and loop fasteners and each including a hook portion and a loop portion, at least one piece of a loop fastener portion thereof being on each of the front and back of the waistband and at least one piece of a hook portion thereof being along the inside of the front and back of the shell at the waist level thereof.

8. A method of anchoring a bullet resistant wearer protective vest in the vicinity of the waist level thereof to the waist of the wearer to thereby maintain bullet resistant wearer protective panels of impact absorbing anti-ballistic material carried thereby to form a nonstretchable enclosure which at least partially protectively surrounds the upper torso of a wearer when the vest is worn, wherein the vest includes a fabric shell having a front, a back and a waist level on the front and back thereof at the approximate height of the waist of the wearer when the vest is worn, the method including the steps of:

providing a lower torso surrounding brief having an elastic waistband and a body portion attached to and extending downwardly from the waistband;

permanently connecting at least one piece of one part of a hook and loop fastener material along a horizontal extent at the front and back of the shell, at the waist level thereof; and permanently connecting at least one piece of an opposite part, mateable with the one part, of the hook and loop fastener material along a horizontal extend at the front and back of the brief in the vicinity of the waistband.

9. The method of claim 8 wherein:

the brief providing step includes the step of providing a legged brief having the body portion thereof formed of a fabric containing an elastic fiber and shaped to include bands thereof that horizontally encircle the thighs of the wearer.

10. The method of claim 9 wherein:

the legged brief providing step includes the step of providing the waistband having a width of at least two inches sewn to the body portion.

11. The method of claim 8 wherein:

the brief providing step includes the step of providing the waistband having a width of at least two inches.

12. The vest of claim 1 wherein:

the body portion is formed of an elastic material including at least some elastic fiber.

13. The method of claim 4 wherein:

the lower garment providing step includes the step of providing a legged brief having a body section formed of an elastic fiber containing material, the body section having leg encircling bands thereof having a width of at least two inches.

14. The method of claim 4 wherein:

the disconnectable fastener providing step includes the step of providing hook and loop fasteners each including a hook portion and a loop portion, at least one piece of a loop fastener portion thereof being on each of the front and back of the waistband and at least one piece of a hook portion thereof being along the inside of the front and back of the shell at the waist level thereof.

* * * * *